US005273250A

United States Patent [19]

Pemberton et al.

[11] Patent Number: 5,273,250

[45] Date of Patent: Dec. 28, 1993

[54] ERGONOMIC KEYBOARD SUPPORT DEVICE

[75] Inventors: Gregory L. Pemberton; Elizabeth Dowler, both of Anchorage, Ak.

[73] Assignee: Situs, Inc., Anchorage, Ak.

[21] Appl. No.: 793,464

[22] Filed: Nov. 18, 1991

[51] Int. Cl.[5] ..... A47B 57/00

[52] U.S. Cl. ..... 248/918; 248/118.3; 108/5

[58] Field of Search ..... 248/664, 676, 918, 919, 248/920, 923, 118, 118.3; 108/5, 6, 143, 148; 312/194, 322, 233.3

[56] References Cited

U.S. PATENT DOCUMENTS 4,625,657 12/1986 Little et al. ..... 108/148 X
4,736,689 4/1988 Stanko ..... 108/5
4,890,561 1/1990 Hampshire ..... 108/145 X
4,913,390 4/1990 Berke ..... 248/118.3
4,943,040 7/1990 Finstad ..... 108/6 X
5,037,163 8/1991 Hatcher ..... 108/143 X

*Primary Examiner*—Alvin C. Chin-Shue
*Attorney, Agent, or Firm*—Shlesinger, Arkwright & Garvey

[57] ABSTRACT

A device for supporting a keyboard apparatus having a top surface generally defined by the top surfaces of the individual keys, includes a frame for mounting the device to a support structure. The frame includes a platform for supporting a keyboard apparatus thereon which is inclined between first and second portions of the frame. A forearm resting member is provided on the keyboard support platform for resting the forearm of an operator while gaining access to the keyboard. The forearm resting member includes a support surface which is substantially coplanar with the top surface of the keyboard apparatus when the keyboard apparatus is positioned on the keyboard support platform.

16 Claims, 3 Drawing Sheets

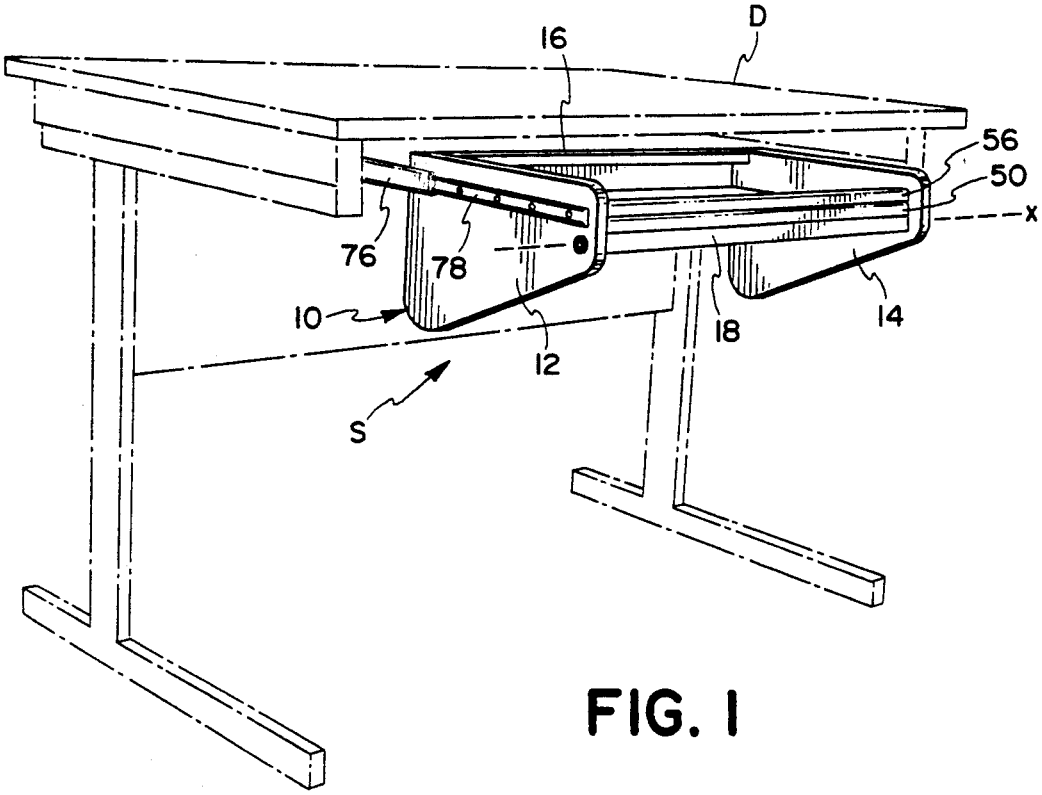
FIG. 1
FIG. 3
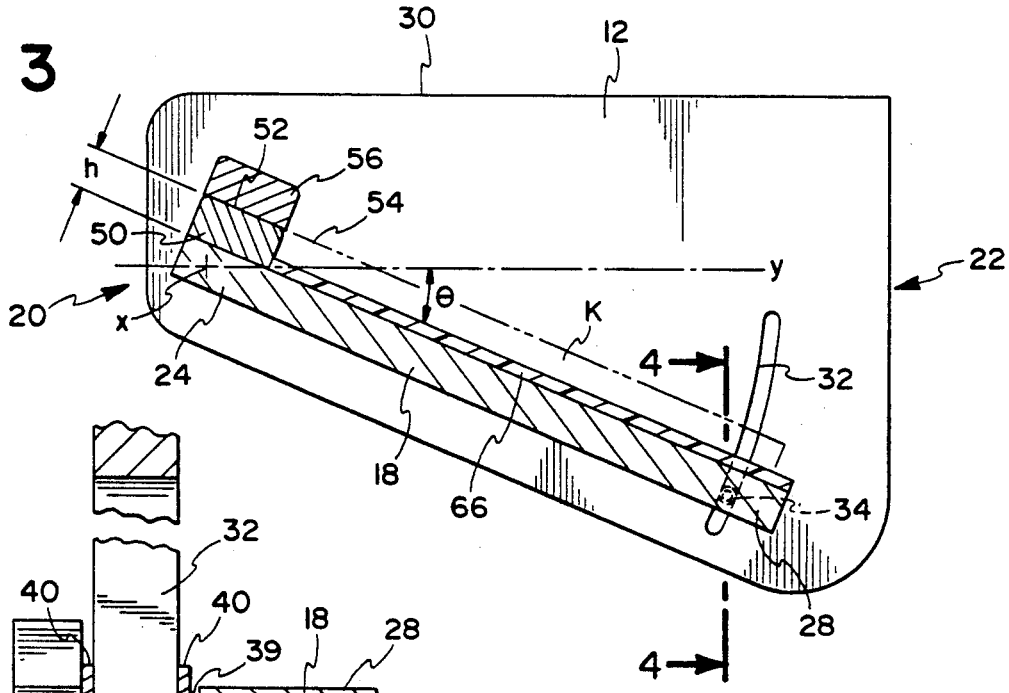
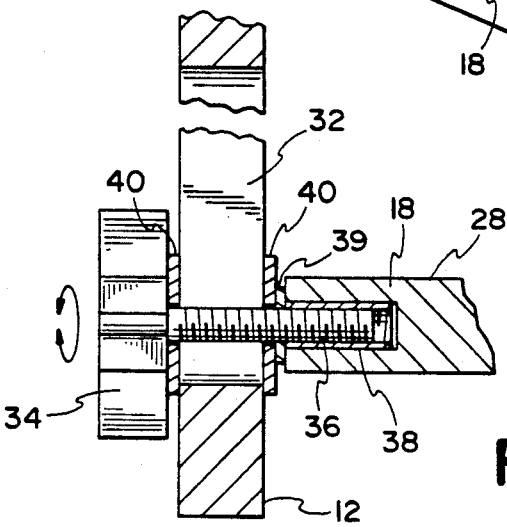
FIG. 4

ERGONOMIC KEYBOARD SUPPORT DEVICE

FIELD AND HISTORICAL BACKGROUND OF THE INVENTION

The present invention is directed to an ergonomically designed support device for a keyboard apparatus or the like.

Electronic word processing equipment is now in widespread use in commercial, industrial, as well as residential applications. The basic components of a word processor comprise a console, which includes the viewing screen, and a keyboard. While in some units the console and keyboard are integral and are adapted to be placed on a conventional desk, the trend has been toward separating the console and keyboard into individual units which, while interconnected electrically, are movable relative to each other so that they may be conveniently positioned in accordance with the space available and the comfort of the operator.

There has been a growing realization that the comfort and well-being of the operator greatly affects productivity. In fact, the term "ergonomics" is now in widespread use to define efforts which seek to adapt working conditions to suit the worker.

Studies have indicated that operator fatigue can be materially reduced if the operator can adjust the relative positions of the keyboard and console as the day progresses. In keeping with these findings, it has hitherto been proposed to provide an adjustable stand for a word processor, the stand having a front section on which the keyboard is seated and a rear section on which the console is seated, the two sections being contiguous and movable vertically relative to each other. While such arrangement provides the ability to adjust the levels of the keyboard and console relative to the operator, the platform sections interrupt the work space available to the operator in that unless the platforms are at the same level the operator does not have an uninterrupted front-to-rear work surface on either side of the keyboard and console, as would be the case if the units were supported on a single, planar desktop or similar surface. In addition, the adjustability of the units is basically in a vertical direction although it has also been proposed to seat the console on a turntable to permit its rotation relative to the surface on which it is supported.

Another problem associated with the use of word processing equipment is that typically the keyboard is supported on a horizontal platform which requires the operator to rest his or her wrists on the portion of the platform lying in front of the keyboard. However, the keys on the keyboard are elevated to a plane higher than the plane of the platform. This requires that the operator elevate and bend the forearm about the wrist in reaching the keys while resting the forearm down below on the platform. The continued use of the keyboard in this manner causes the user to develop the symptoms of conditions known as "carpal tunnel" and "tendonitis", or fatigue of wrist muscles. Other muscle related abnormalities of the arm may also develop as a result of the continued use of a keyboard in this manner.

Various support mechanisms have been devised in the art, and examples are same are shown in U.S. Pat. Nos. 4,379,429; 4,481,556; 4,482,063; 4,482,064; 4,496,200; 4,483,572; 4,515,086; 4,568,056; 4,616,798; 4,621,781; 4,638,969; 4,901,972; 4,988,066; 4,989,167 and, U.S. Pat. No. 33,556.

There is, however, a need for an ergonomically designed keyboard support device which overcomes the disadvantages associated with the conventional keyboard supports.

OBJECTS AND SUMMARY OF THE INVENTION

The principal object of the present invention is to provide an ergonomically designed support device for a keyboard apparatus or the like which prevents and reverses the symptoms of "carpal tunnel" and "tendonitis", commonly known as fatigue of the wrist muscles.

Another object of the present invention is to provide an ergonomically designed support device for a keyboard apparatus or the like which facilitates relaxation of the whole arm during pauses in keying operation.

Yet another object of the present invention is to provide an ergonomically designed support device for a keyboard apparatus or the like which is simple in structure, inexpensive to manufacture, easy to use, and saves space.

An additional object of the present invention is to provide an ergonomically designed support device for a keyboard apparatus or the like which can be easily retrofitted onto many existing tabletops or other stationary support surfaces so as to permit existing equipment to be easily and readily converted for use with the word processing equipment without the need for specialized support structures for this purpose.

Yet additional object of the present invention is to provide an ergonomically designed support device for a keyboard apparatus or the like which can be easily stored when not in use.

A further object of the present invention is to provide an ergonomically designed support device for a keyboard apparatus or the like which can be easily adjusted to accommodate the comfort level for different users.

Yet a further object of the present invention is to provide an ergonomically designed support device for a keyboard apparatus or the like which is compact and can be easily taken apart for shipping and then easily assembled at the user's location.

In summary, the main object of the present invention is to provide an ergonomically designed support device for a keyboard apparatus or the like which substantially reduces fatigue of the wrist muscles.

BRIEF DESCRIPTION OF THE DRAWINGS

The above and other objects, advantages, and other features of the present invention will become apparent from the following detailed description of the invention illustrated in the accompanying drawings, in which:

FIG. 1 is a perspective view of the support device of the invention, shown mounted to the underside of a tabletop;

FIG. 3 is a partial enlarged sectional view taken along line 3—3 of 2;

FIG. 4 a partial enlarged view taken along line 4—4 of FIG. 3;

DETAILED DESCRIPTION OF THE INVENTION

Figure 7:
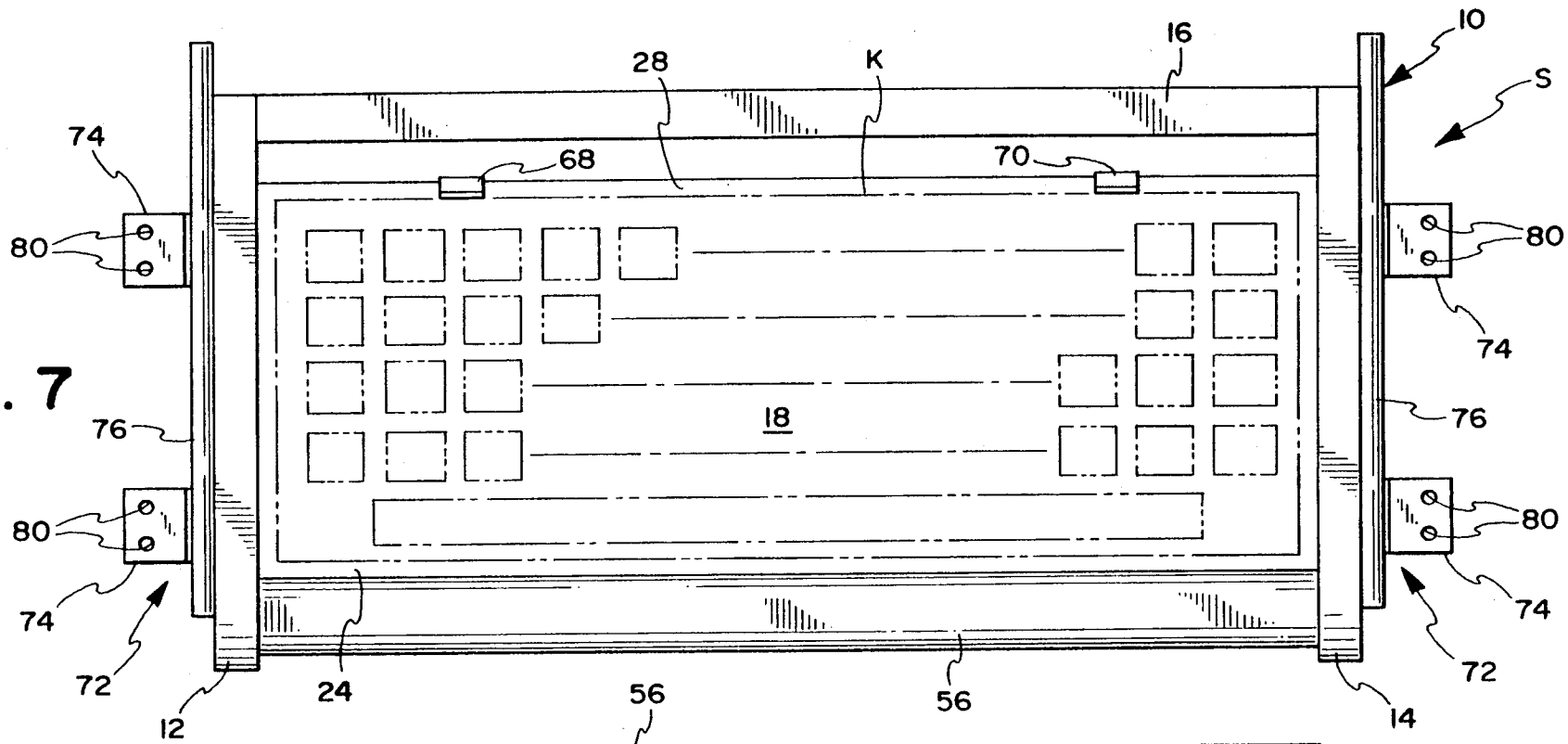
FIG. 7 is a top plan view of the device of the invention, showing the keyboard in phantom lines.

As best shown in FIGS. 1 and 7, the support device S of the invention has the configuration of frame 10 that can be easily mounted on the underside of a conventional desk D. The frame 10 includes two end supports 12 and 14 interconnected by a horizontally extending cross-brace 16 on the rear thereof. A generally planar platform 18 extends between end supports 12 and 14 for supporting a keyboard K or the like apparatus, shown in FIG. 7.

Figure 5:
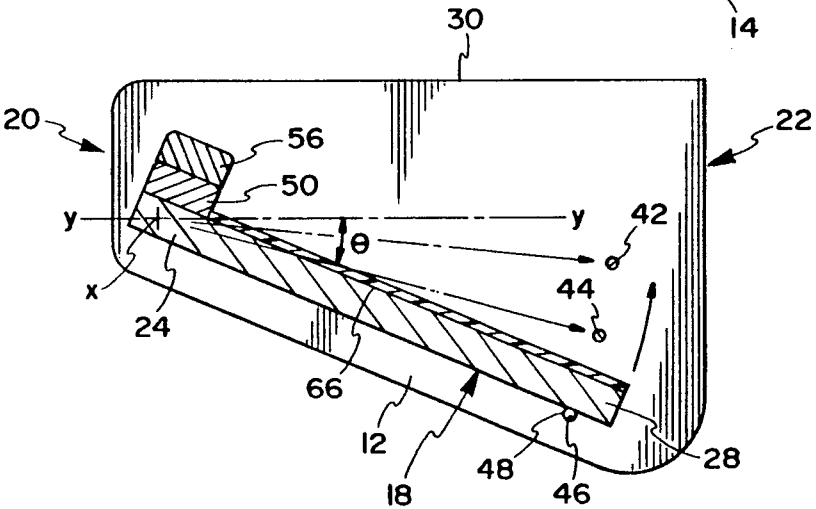
FIG. 5 is a view similar to FIG. 3, showing an alternate embodiment of the adjusting mechanism for the support platform.
Figure 6:
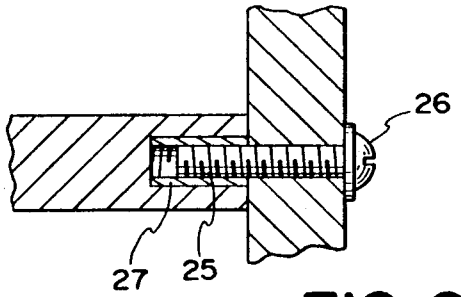
FIG. 6 is a partial enlarged sectional view taken along line 6—6 of FIG. 2.

The platform 18, as best shown in FIGS. 3 and 5, is downwardly inclined away from the front 20 of device S to the rear 22 thereof. The downward incline is stabilized by pivotally fixing front 24 of platform 18 by horizontally extending screw fasteners 26, FIGS. 2 and 6. In particular, screw-threaded shank 25 of each screw-fastener 26 extends through the thickness of corresponding supports 12 and 14 and is received in screw-threaded, preferably metallic, insert 27 embedded in platform 18, shown in FIG. 6. The two screw-fasteners 26 thus extend along a common horizontal axis x about which platform 18 pivots, best shown in FIGS. 1-3 and 5.

The rear 28 of the platform 18, however, is not fixed in its position relative to top surface 30 of frame 10 and is vertically adjustable so as to obtain a desired degree of incline relative to top surface 30, or a horizontal plane y extending through the axis x and parallel to surface 30, shown in FIGS. 3 and 5. The angle of inclination $\theta$ is preferably kept between 0° to about 70°.

As shown in FIGS. 3-4, end support 12 is provided with an arcuate slot 32 having received therein a clamp pin 34 (the end support 14 having the mirror-image configuration of support 12). The shank 36 of pin 34 is screw-threaded and extends through the thickness of end support 12 and is received in a correspondingly aligned screw-threaded, preferably metallic, insert 38 embedded in platform 18. Nut 39 and washers 40 are provided for tightening pin 34 about end support 12. For the ease of turning pin 34, the head thereof may be knurled. As shown in FIGS. 3 and 4, the platform angle of inclination $\theta$, or the vertical position of its rear 28, can be easily changed by unclamping pin 34 and raising or lowering platform 18 by pivoting about axis x until a desired elevation is reached, and then clamping pin 34 for stabilizing the platform 18 at the desired elevation.

FIG. 5 illustrates an alternate embodiment for inclining platform 18 to a desired elevation relative to top surface 30. More specifically, in this embodiment, three holes 42, 44 and 46 are provided on the end support 12, in place of the arcuate slot 3 (the end support 14 having the mirror image configuration of support 12). As shown in FIG. 5, a peg 48 is selectively placed in one of the three holes in the end support 12 for supporting the rear 28 of platform 18. By selectively changing the position of peg 48 in one of the three holes 42, 44 and 46, a desired, prefixed degree of inclination may be obtained. In other words, and as clearly shown in FIG. 5, the positions of the holes 42, 44 and 46, relative to top surface 30, are different and designate preselected, varying values for the angle of inclination $\theta$. It is preferable to locate holes at 5° increments. For example, 10°, 15°, 20°, 25°, etc. It should be noted that it is well within the scope of this invention to vary the number of holes, each designating a preselected value for the angle of inclination $\theta$.

As best shown in FIGS. 1-3, 5 and 8, a forearm support 50 extends across the width of platform 18 on the front 24 thereof. The height h of the forearm support 50 is selected such that the upper surface 52 thereof is substantially coplanar with the upper surface 54 of the keyboard K generally defined by the top surfaces of individual keys, shown in FIG. 3. Preferably, the height h of support 50 relative to platform is about ¾ to 1 ½. This arrangement therefore allows the user to rest his or her forearm or wrist on the upper surface 52 of the forearm support 50 and glide across comfortably while using the keyboard K. In other words, since both the forearm (or the wrist) and the top surface 54 of the keyboard K extend in a common plane, the need to undesirably bend the hand about the wrist in order to reach the keys across the keyboard is eliminated.

Figure 8:
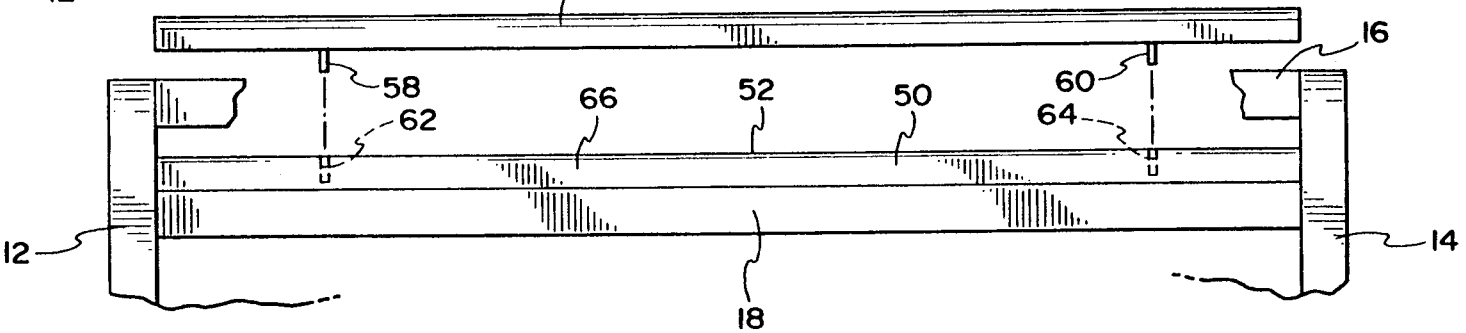
FIG. 8 is a partial front elevational view of the device shown in FIG. 2, shown with an auxiliary forearm support

As shown in FIG. 8, an auxiliary forearm support 56, generally corresponding in dimension to the forearm support 50, can be easily mounted atop thereof for additional comfort or to accommodate a different user. The auxiliary support 56 includes pins 58 and 60 that are received in corresponding recesses 62 and 64 in forearm support 50 to prevent sliding therebetween. It should be noted that other conventional means may be employed to attach or mount auxiliary support 56 on forearm support 50.

As best shown in FIGS. 3 and 5, platform 18 has mounted thereon a thin sheet 66 of an antiskid material, such as closed cell foam, for preventing sliding of keyboard K thereon. Further, two retaining clips 70 are provided on the rear 28 of platform 18 for securing keyboard K thereon and to prevent its fall or sliding due to gravity, FIG. 7.

Figure 2:
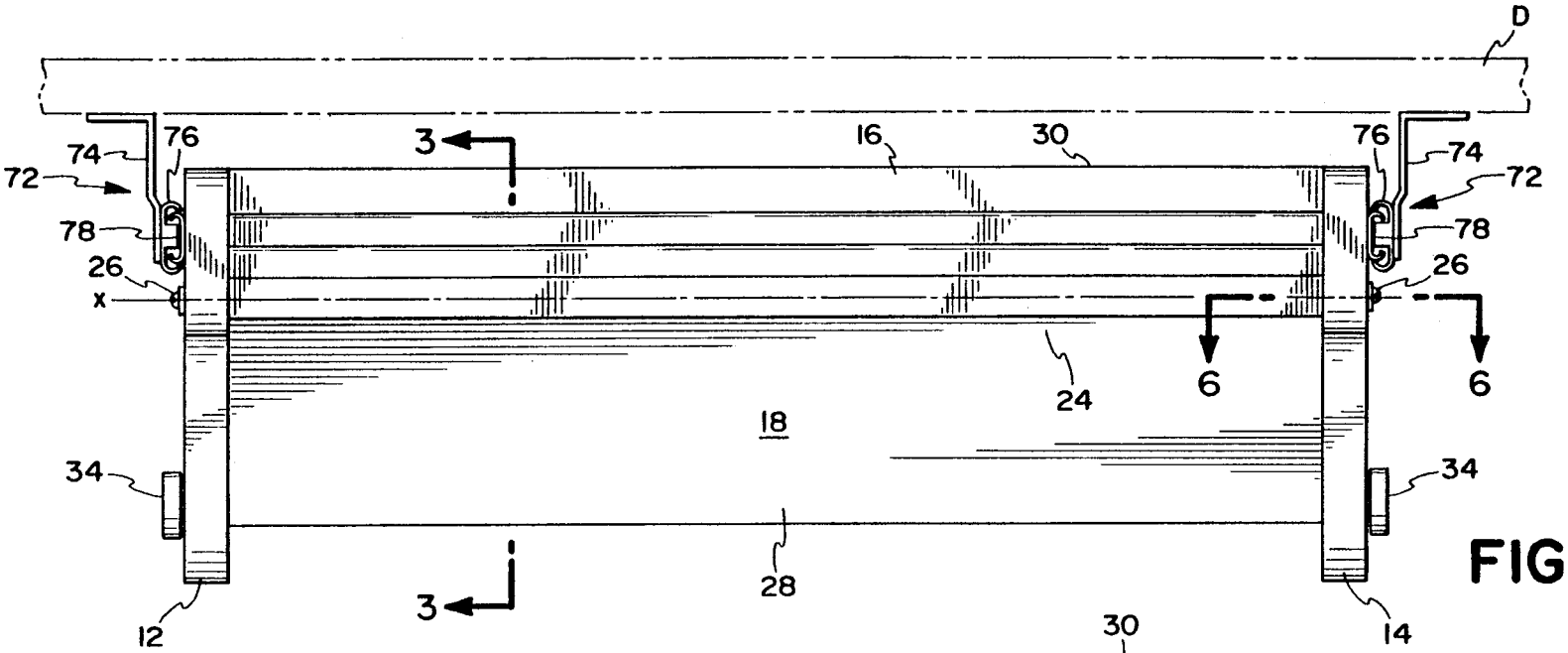
FIG. 2 is a partial front elevational view thereof.

As shown in FIGS. 2 and 7, each end support 12 and 14 has mounted on the outside thereof a slide rail mechanism 72 for mounting support device S to the desk D. More particularly, each slide mechanism 72 includes two generally L-shaped brackets 74 mounted to a generally C-shaped slide rail 76, best shown in FIG. 2. Each slide rail 76, on the other hand, is in sliding contact with a generally C-shaped guide rail 78 mounted on the outside of the end supports 12 and 14. In this manner, support device S, when mounted to the underside of desk D, can be easily pulled out for gaining access to keyboard K, and pushed back under the desk D when it is no longer desired to use the keyboard K. It should be noted that other means for mounting device S to a support structure may be substituted for slide mechanism 72. For example, C-clamps may be used to easily mount the device S to different tabletops or to move from one location to another. Further, the device S can be fixedly mounted to a support structure by conventional means.

In FIG. 7, reference numerals 80 designate holes in brackets 74 for mounting the device S to a support structure, such as desk D, by conventional screw-fastener or the like.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A device for supporting a keyboard apparatus having a top surface generally defined by the top surfaces of the individual keys, the device comprising:
(a) frame means slidably mounted to a support structure;
(b) said frame means including means for supporting a keyboard apparatus thereon;
(c) said frame means including first and second portions;
(d) said keyboard supporting means being inclined between said first and second portions of said frame means;
(e) means adjacent said keyboard supporting means for resting the forearm of an operator while gaining access to said keyboard apparatus;
(f) said forearm resting means including a support surface substantially coplanar with the top surface of said keyboard apparatus when said keyboard apparatus is positioned on said keyboard supporting means;
(g) said keyboard supporting means including front and rear portions;
(h) said front portion of said keyboard support means being pivotally fixed to said frame means and said rear portion being adjustable relative to said frame means;
(i) said frame means including a pair of laterally spaced end supports each having an upper surface extending above said keyboard supporting means;
(j) said first portion of said frame means comprising the front of the device and said second portion thereof comprising the rear of the device; and
(k) said keyboard supporting means being inclined downwardly from the front to the rear of the device.

2. The device of claim 1, wherein:
(a) said frame means includes an upper surface; and
(b) said keyboard supporting means is inclined to have an angle of about 0° to about 70° relative to said upper surface of said frame means.

3. The device of claim 1, wherein:
(a) said rear portion of said keyboard supporting means is movable about an arcuate path between first and second positions.

4. The device of claim 3, and including:
(a) means for selectively adjusting the position of said keyboard supporting means relative to said frame means between and including said first and second positions.

5. The device of claim 4, wherein:
(a) said position adjusting means comprises a plurality of holes and a projection member to be selectively received in one of said holes.

6. The device of claim 4, wherein:
(a) said position adjusting means comprises a slot and a projection member extending through said slot.

7. The device of claim 1, and including:
(a) means for adjusting the incline of said keyboard supporting means.

8. The device of claim 1, wherein:
(a) said keyboard supporting means includes an anti-skid surface.

9. The device of claim 1, wherein:
(a) said keyboard supporting means includes means for securely holding said keyboard apparatus thereon.

10. The device of claim 1, wherein:
(a) said support surface of said forearm resting means is elevated relative to said keyboard supporting means; and
(b) means for adjusting the elevation of said support surface of said forearm resting means.

11. The device of claim 1, in combination with a support structure.

12. A device for supporting a keyboard apparatus having a top surface generally defined by the top surfaces of the individual keys, the device comprising:
(a) frame means slidably mounted to a support structure;
(b) said frame means including means for supporting a keyboard apparatus thereon;
(c) said frame means including first and second portions;
(d) said keyboard supporting means being inclined between said first and second portions of said frame means;
(e) means adjacent said keyboard supporting means for resting the forearm of an operator while gaining access to said keyboard apparatus;
(f) said forearm resting means including a support surface elevated to a plane higher than the top surface of said keyboard apparatus when said keyboard apparatus is positioned on said keyboard supporting means;
(g) said keyboard supporting means including front and rear portions; and
(h) said front portion of said keyboard support means being pivotally fixed to said frame means and said rear portion being adjustable relative to said frame means;
(i) said frame means including a pair of laterally spaced end supports each having an upper surface extending above said keyboard supporting means;
(j) said first portion of said frame means comprising the front of the device and said second portion thereof comprising the rear of the device; and
(k) said keyboard supporting means being inclined downwardly from the front to the rear of the device.

13. The device of claim 12, and including:
(a) means for adjusting surface of said forearm resting means relative to said keyboard supporting means.

14. The device of claim 12, and including
(a) means for adjusting the incline of said keyboard supporting means.

15. The device of claim 12, wherein:
(a) said frame means includes an upper surface; and
(b) said keyboard supporting means is inclined to have an angle of about 0° to about 70° relative to said upper surface of said frame means.

16. The device of claim 12, in combination with a support structure.

* * * * *